United States Patent [19]

Bald et al.

[11] Patent Number: 4,862,570

[45] Date of Patent: Sep. 5, 1989

[54] APPARATUS FOR REMOVAL OF SCALE FROM HOT-ROLLED STEEL STRIP

[75] Inventors: Wilfried Bald, Hilchenbach; Karl-Ernst Boucke, Grevenbroich; Hans Römmen, Dormagen; Manfred Fritz, Erkrath; Friedrich Hollmann, Grevenbroich, all of Fed. Rep. of Germany

[73] Assignee: SMS Schloemann-Siemag Aktiengesellschaft, Dusseldorf, Fed. Rep. of Germany

[21] Appl. No.: 905

[22] Filed: Jan. 6, 1987

[30] Foreign Application Priority Data

Jan. 7, 1986 [DE] Fed. Rep. of Germany ..... 3600144

[51] Int. Cl.[4] ..... B21B 45/06

[52] U.S. Cl. ..... 29/81 A; 72/40; 409/139

[58] Field of Search ..... 409/139; 72/40, 243, 72/247, 249, 811, 21; 29/81 R, 81 A

[56] References Cited

U.S. PATENT DOCUMENTS

| | | | |
|---|---|---|---|
| 567,756 | 9/1896 | Strite | 72/40 |
| 1,077,696 | 11/1913 | Fuller | 72/40 |
| 1,698,637 | 1/1929 | Kessler | 409/139 |
| 2,256,520 | 9/1941 | Johansen et al. | 72/40 |
| 3,039,513 | 6/1962 | Lasiewicz et al. | 72/40 |

FOREIGN PATENT DOCUMENTS

| | | | |
|---|---|---|---|
| 137030 | 11/1978 | Japan | 72/40 |
| 157518 | 9/1983 | Japan | 72/40 |
| 716662 | 2/1980 | U.S.S.R. | 72/40 |
| 1093379 | 5/1984 | U.S.S.R. | 72/40 |

*Primary Examiner*—Gil Weidenfeld
*Assistant Examiner*—Daniel W. Howell
*Attorney, Agent, or Firm*—Herbert Dubno

[57] ABSTRACT

An apparatus is provided for removing scale from a hot rolled steel strip by rolls acting by grinding and/or milling so that these rolls are uniformly effective in all regions of the steel strip and an appropriate uniform removal of the scale layer occurs. This is attained when driven grinding rolls adjustable toward the surfaces of the steel strip are provided of which at least two opposing rolls are axially slidable in opposite directions and have inversely oriented S-shape contours. These contours complement each other completely flawlessly in one definite position of the grinding rolls. In one such position the rolls provide a uniform engagement on both sides of a steel strip with a nearly rectangular profile. In fact the rolls by appropriate axial sliding and application of bending forces if necessary may be adjusted to fit the actual profile of the steel strip so that a uniform engagement on the scale layer is guaranteed and a locally excessive grinding and/or milling in the central region of the steel strip is avoided.

6 Claims, 2 Drawing Sheets

APPARATUS FOR REMOVAL OF SCALE FROM HOT-ROLLED STEEL STRIP

FIELD OF THE INVENTION

Our present invention relates to an apparatus for the removal of scale from hot-rolled steel strip and, more particularly, to an apparatus for the removal of scale from hot rolled steel strip by a grinding or milling operation, particularly before pickling of the strip in a corrosive chemical bath.

BACKGROUND OF THE INVENTION

Hot-rolled steel has a surface-adhering scale layer which must be removed before further reduced in a cold rolling process since the scale can otherwise be rolled into the surface of the steel strip and flows or imperfections, particularly surface imperfections, will result.

Usually the scale layer is removed by a pickling action by corrosive attack in a chemical bath. Particularly thick scale layers require comparatively long treatment times so that the bath used must have disadvantageously large bath dimensions. It has also been show that regenration of the bath fluid or disposal of the ued bath fluid are also problems. Hence it has been proposed to break loose the scale layer by rolls in a rolling mill stand to provide new surfaces for the bath fluid to attck and to remove the scale layer at least partially before it reaches the bath.

Removal of the scale layer by belt grinding has also been attempted. Inspite of many belt changes, however, such a grinding has not proven to be sufficient or efficient because, in part, it is difficult to apply a pressing force as high as is required for effective grinding. Conventional support of the grinding strip however affords no large bearing surface so that the scale layer is engaged substantially only in a limited width region.

German Printed Application DE-AS 10 09 584 describes, the guiding of a steel strip to be descaled between bending rolls under a strong tractile force applied both at the outlet and at the inlet side. This, however, has proved not to provide sufficient descaling action. Also the cold hardening caused by the bending has been shown to be disadvantageous.

Also a reducing roll technique according to U.S. Pat. No. 2,650,888 or German Patent 28 08 299 has not proved wholly satisfactory since in such a roll as a result of the high pulling force applied, additional drive rolls acting upon the steel strip are required and as a result a high capital expense is incurred and the space requred is increased. Moreover, it is scarcely possible to maintain the profile shape of the steel strip as required so that a strain free roll strip at the output is obtained.

According to German Patent 886 585 the steel strip is fed between a roll pair with roughened surfaces whose rolls are driven with different speeds, but so that the directions of the peripheral velocity of the bodies of the rolls contacting opposite sides of the steel strips runs are the same. One of the rolls runs faster than the speed of the steel strip, the other roll running slower. Thus an abrading away of the scale layer will occur with a mill like corrugation of a suitable design providing the textured surfaces of the rolls. Also here it is not possible to take into account the special shape of the profile of the processed steel strip so that in thicker portions of the steel strip, metal can be unnecessarily eroded away while in the thinner region the scale layer may only be slightly removed or practically not removed at all.

OBJECTS OF THE INVENTION

It is an object of our invention to provide an improved apparatus for removal of scale from hot-rolled steel strip which obviates these drawbacks.

It is also an object of our invention to provide an improved apparatus for removal of scale from hot-rolled steel which allows a completely effective, efficient and uniform grinding away and/or milling of the scale layer of the hot rolled steel with reduced expense.

SUMMARY OF THE INVENTION

These objects and others which will become more readily apparent hereinafter are attained in accordance with our invention in an apparatus for removing scale from a hot-rolled steel strip by grinding or milling, especially before feeding the steel strip into a corrosive chemical bath, i.e. before pickling the strip.

According to our invention a plurality of driven grinding rolls adjustable toward the surface of the steel strip are provided in a stand having at least two opposing rolls slidable axially in opposite directions. The bodies of these rolls are each formed with an inverse S-shape contour in such a way that the contours complement each other perfectly (i.e. in a gap-free manner) in a certain axial position of the grinding rolls. By using axially slidable grinding rolls in connection with a contoured surface as is known from German Patent 30 38 865 the shape of the gap enclosed by the grinding rolls is adjusted to fit the profile of the steel strip to be descaled so that a uniform engagement on the entire surface of the steel strip is possible and with it also a uniform removal is guaranteed.

Advantageously, th bodies of the grinding rolls can be provided with an abrasive surface, a grinding substance or medium can be fed to or between the bodies of the grinding rolls, and/or the bodies of the grinding rolls can be formed with cutting or milling edges.

In one embodiment of our invention a bending device for the grinding rolls is associated with a bearing member of the roll pins of the grinding rolls. Supporting or backup rolls bracing the grinding rolls at least in the vicinity of the bodies of the grinding rolls can be provided by analogy with the rolls of four-high and six-high rolling mills.

A plurality of grinding roll pairs or sets can be provided in succession along the path of the steel strip.

A control device based on a value predetermined or measured by a detector indicating the profile of the steel strip can cause inverse axial sliding of the profiling grinding rolls and if necessary bending forces which fit the contacting generated surface line of the grinding rolls to the curvature of the profile of the steel strip.

The control device can comprise a plurality of optical sensors detecting opposing surfaces of the steel strip and in sensing of the profile of the steel strip can ascertain where the scale is present and where clean metal is detectable.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
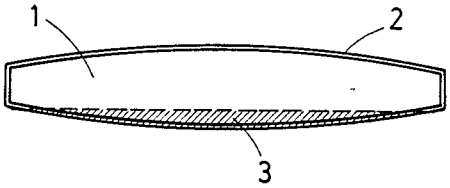
FIG. 1 is a transverse cross sectional view showing in dimensionally and proportionally exaggerated form a profile of a steel band with the results of a conventional milling operation indicated.

In FIG. 1 a cross sectional view through a hot rolled steel strip 1 is shown whose convex profile has been exaggerated for illustration.

The steel strip 1 has on all sides a layer of scale 2. If this scale layer 2 is to be removed by grinding or milling it is necessary that the contour or shape of the profile of the steel strip be considered. This does not occur or will not occur when for example a simple linear miller or cutter is used and the cutting is along a chord. Not only is only part of the scale layer removed but also a region 3 of metal is also removed so that the steel strip 1 experiences a shape change. The process is highly expensive since not only the scale but also a considerable metal portion is removed in the central region of the steel strip 1 which results in a disadvantageous loss.

In FIG. 1 an apparatus for grinding or cutting away a scale layer of a hot rolled steel strip 4 is schematically illustrated.

Above and below the steel strip 4, grinding or milling rolls 5 and 6 are provided in a stand S whose bodies 5*a* and/or 6*a* are not as is usual cylindrical or some simple shape but instead are provided with a specially ground surface contour which is a simple shallow S-shape.

The rolls may conform to S-shaped rolls used in rolling mill stands and, indeed, the stand, the journals for the rolls, the means for axially shifting bending them, bending them and pressing them against the strip can correspond to the systems used in rolling mills. Here, however, grinding surfaces or milling surfaces are provided and the rolls are driven at peripheral speeds different from the linear velocity of the strip.

Figure 2:
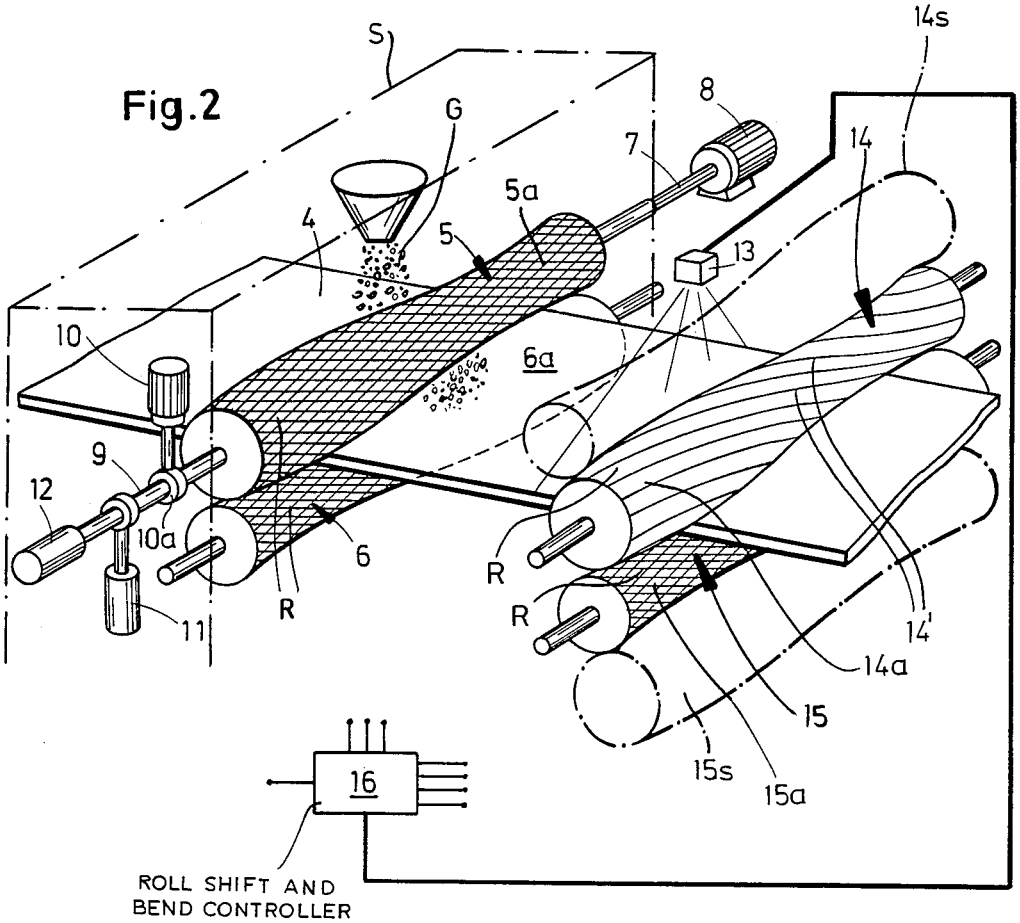
FIG. 2 is a perspective schematic view of an apparatus having two devices for removing scale from hot-rolled steel strip according to our invention, each with two grinding or milling rolls.

The proportions of the rolls are also exaggerated in FIG. 2 to allow the S shape to be fully appreciated.

Figure 3:
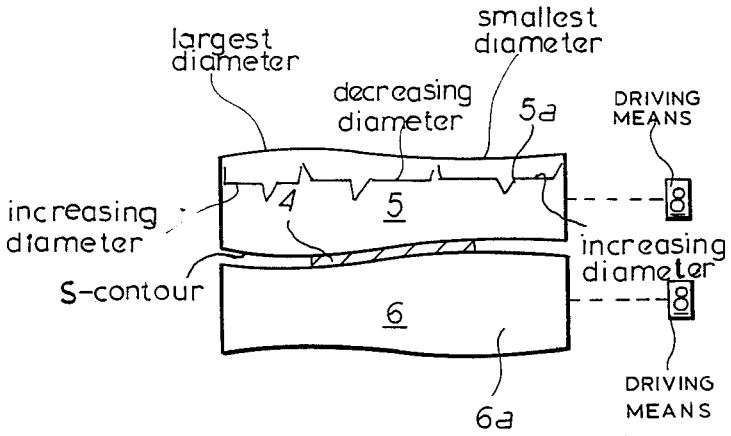
FIG. 3 is a diagrammatic elevational view of the rolls.

While the grinding roll 5 (from left to right in FIG. 2) first increases in diameter then decreases to a minimum only to increase in diameter again in the region 5*a*, the diameter of the grinding roll 6 (from left to right) decreases and then increases in diameter to a maximum in the region 6*b* and thereafter decreases at its right hand side in FIG. 2 (see also FIG. 3). Thus the S-shape contours of the grinding rolls 5 and 6 are inverse to one another.

The effect obtained by this shape of the rolls and the ability to axially displace them is described for example in German Patent 30 38 865. When the rolls are pressed axially together, the symmetrical positioning of both working rolls 5 and 6 results in a gap-free disposition of the rolls. On separation of the grinding rolls an equidistant gap between them results. When the rolls are pressed against the strip, full surface grinding is effective.

The drive side roll pins of the grinding rolls 5 and 6 are connected by spindles 7 with drive motors 8 only one of which has been shown.

Since the grinding rolls 5 and 6 are axially slidable the spindles 7 are appropriately constructed for example to telescope to permit the sliding.

With the aid of the roll pins 9 of the grinding roll 5 the mounting is shown symbolically. On the bearing or structural member 10*a* supporting the roll pin 9 an adjusting apparatus 10 engages which is shown as a hydraulic cylinder to enlarge or reduce the gap width and vary the pressing force against the strip.

A bending cylinder 11 acts on this same roll pin and/or on the surrounding bearing and/or structural member to apply bending moments to the rolls and adjust the contour of the gap between them.

The piston of a positioning cylinder 12 is also shown to be coupled with the roll pin 9. In practice however this positioning device 12 or cylinder is provided on the drive side as well to make grinding roll change simpler. The indicated arrangement has been illustrated to simplify viewing in the drawing and for the same reason a corresponding arrangement for the grinding roll 6 is only partially shown although it is similar for the drive side positioning apparatus and the drive side bending cylinder not shown of the grinding roll 5.

Above the steel strip 4 a detector 13 is provided which is formed to detect the profile of the steel strip 4.

Since in many cases, particularly in cases with extensive scaling, one grinding roll pair is not enough and additional grinding or milling roll pairs, in this embodiment pairs of grinding rolls 14 and 15, following the grinding or milling roll pair 5 and 6 are provided.

In operation the steel strip 4 is guided between the grinding rolls 5 and 6 and/or the grinding or milling rolls 14 and 15 and the rolls are urged with suitable pressure against it.

To keep the scale removal uniform the profile shape of the steel strip 4 is detected by the detector 13 and evaluated by a programmed control device 16. The control device 16 is provided with the actual value both of the displacement and/or the exerted force of the positioning device 12 and the actual value of the axial displacement of the grinding roll 5 as well as the bending force exerted by the bending cylinder 11. On the basis of these predetermined values the control device 16 adjusts both the positioning and the bending force, particularly however, by axially opposing sliding of the grinding rolls of the roll pair, e.g. the grinding or milling rolls 5 and 6, in such a way that the gap formed between the grinding rolls corresponds to the profile shape of the steel strip 4.

Thus the surfaces of the strip are uniformly abraded by the grinding or milling rolls 5 and 6 and the scale layer worn away practically uniformly.

To obtain the grinding action the grinding or milling rolls 5 and 6 for example can be formed with a suitably textured surface indicated by the cross lining R in the drawing. It is also appropriate, if necessary additionally, to feed a suitable abrasive grinding substance G in FIG. 2 to the grinding or milling rolls 5 and/or 6. It is also possible to equip the grinding rolls with milling edges or blades having cutting edges 14' which remove the scale layer according to milling principles.

We have found that, by axially opposing sliding of the grinding rolls provided with the special shaped surface contour their lines of contact on the strip can be fit to the profile of the steel strip.

A further adjustment or fit can be obtained by the additional application of bending forces and thus by bending the rolls as described. It is also possible to provide additional supporting rolls (for exammple, the back up rolls 14*s* and 15*s* for the grinding rolls 14 and 15 in FIG. 2) supporting the grinding rolls at least where these engage the strip and whose peripheral speeds correspond to those of the grinding rolls.

The detection of the shape of the profile of the steel strip 4 for transmission to the control device 16 can be substituted by a manual data entry or by an entry by data transmission.

It is also possible, for example to use thickness meters or thickness meter detection points distributed over the width of the steel strip. With a surface or optical sensor this can be done entirely by sensing the lower side. It is also possible to provide an optical sensor which so reacts to light-dark values that it is in a position to discriminate the remaining scale from bare metal and to automatically adjust the grinding roll arrangement to control the uniformity of the attained grinding action and, as required, to correct the grinding action by profile changes of the formed gap.

It has also been found that the apparatus for grinding and/or milling acting accordng to the sliding roll process of the invention can effectively be inserted after a rolling mill breaking and loosening scale. In all case a considerable easing of the problems for the subsequent pickling bath is obtained by a thoroughgoing and uniform removl of scale from the steel strips so that the bath works with a reduced dwell time and a reduced length.

We claim:

1. An apparatus for mechanical descaling of a hot-rolled steel strip comprising a plurality of rolling mills positioned along a linear path of a steel strip to be descaled, each of said rolling mills comprising:

a pair of S-shaped driven descaling rolls receiving said steel strip between them and rotatable about respective axes of rotation in opposite directions, said rolls having structured abrading surfaces;

means for shifting said rolls of each pair axially in directions opposite to one another, said rolls being positioned inversely to one another and shaped so that said rolls complement each other perfectly in at least one relative axial position of the rolls of each pair with no gap between them, said surfaces of said rolls being in continuous contact with a contour of said strip to be descaled;

means for moving said rolls of each pair toward the surface of said strip; and respective driving means for driving said rolls in opposite senses about the respective axes and having respective drive shafts, each of said S-shaped rolls being mounted on a respective one of said shafts and being rotatable at peripheral speeds different from a linear velocity of the strip to be descaled for uniform scale removal from said strip.

2. The apparatus defined in claim 1, further comprising means for detecting said contour of said strip to be rolled above and below said strip and for ascertaining where scales of said strip to be descaled is present.

3. The apparatus defined in claim 2, further comprising means for applying bending forces to said rolls.

4. The apparatus defined in claim 2, further comprising means for controlling an axial shaft on said rolls and bending forces of each of said rolls comparing actual signals received from said means detecting the contour with predetermined values and producing resulting signals.

5. The apparatus defined in claim 1 wherein each of said rolling mills comprises at least one pair of backup rolls supporting the respective pair of descaling rolls.

6. The apparatus defined in claim 5 wherein said backup rolls are S-shaped rolls.

* * * * *